US010113320B1

(12) United States Patent
Cataldi et al.

(10) Patent No.: US 10,113,320 B1
(45) Date of Patent: Oct. 30, 2018

(54) RESTRAINT SYSTEM FOR ELEVATED FLOORING TILES

(71) Applicant: United Construction Products, Inc., Denver, CO (US)

(72) Inventors: Francesco Cataldi, Lakewood, CO (US); William R. Heimbuch, Denver, CO (US); William E. Kugler, Denver, CO (US); Lisa K. von-Gunten, Denver, CO (US)

(73) Assignee: United Construction Products, Inc., Denver, CO (US)

( * ) Notice: Subject to any disclaimer, the term of this patent is extended or adjusted under 35 U.S.C. 154(b) by 0 days.

(21) Appl. No.: 15/921,324

(22) Filed: Mar. 14, 2018

Related U.S. Application Data

(60) Provisional application No. 62/581,141, filed on Nov. 3, 2017.

(51) Int. Cl.
*E04F 15/024* (2006.01)

(52) U.S. Cl.
CPC .. *E04F 15/02452* (2013.01); *E04F 15/02464* (2013.01)

(58) Field of Classification Search
CPC ..... E04F 15/02405; E04F 15/02155; E04F 15/0215; E04F 15/02458; E04F 15/02447; E04F 15/02452; E04F 15/02464
USPC ..... 52/126.5–126.7, 134, 137, 139, 263, 52/506.06; 248/188.4, 188.5, 354.1, 248/354.3, 357
See application file for complete search history.

(56) References Cited

U.S. PATENT DOCUMENTS 4,922,670 A 5/1990 Naka
4,996,804 A * 3/1991 Naka ..... E04F 15/02452 52/126.1
5,333,423 A * 8/1994 Propst ..... E04F 15/02476 248/188
6,151,854 A 11/2000 Gutjahr
6,161,353 A 12/2000 Negola et al.
6,260,320 B1 7/2001 Di Lorenzo
(Continued)

FOREIGN PATENT DOCUMENTS

EP 1509376 3/2010
GB 2036847 B 7/1980
(Continued)

OTHER PUBLICATIONS

Brochure entitled Exotic Wood Tile Installation, Bison Deck Supports, a United Construction Products, Inc. Company, dated Jun. 2007.

(Continued)

*Primary Examiner* — Brian E Glessner
*Assistant Examiner* — Adam G Barlow
(74) *Attorney, Agent, or Firm* — Marsh Fischmann & Breyfogle LLP; Jonathon A. Szumny

(57) ABSTRACT

A restraint system for an elevated building surface assembly including restraint members that are receivable in gaps adjacent outer edge segments of flooring units to secure the flooring units to an underlying support structure. The restraint members may be readily manipulated to allow for the selective removal of one or more of the flooring units for replacement thereof, access to the support structure, and/or the like.

20 Claims, 17 Drawing Sheets

(56) References Cited

U.S. PATENT DOCUMENTS 6,363,685 B1 * 4/2002 Kugler ..... E04F 15/02183 52/126.6
6,402,415 B1 6/2002 Eberle, III
6,751,917 B2 6/2004 Mao
6,818,275 B2 11/2004 Guarda et al.
6,911,248 B2 6/2005 Sabatini
7,536,835 B2 5/2009 Schluter
7,694,480 B2 4/2010 Niese
7,770,354 B2 8/2010 Bui
7,891,149 B2 2/2011 Turner et al.
7,918,059 B2 * 4/2011 Repasky ..... E04D 11/007 52/126.4
7,958,688 B2 6/2011 Vilar Llop
7,993,731 B2 8/2011 Miller et al.
8,002,943 B2 8/2011 Brown et al.
8,122,612 B2 * 2/2012 Knight, III ..... E04D 11/007 33/199 R
8,146,319 B2 4/2012 McIntosh et al.
8,186,116 B2 5/2012 Anderson
8,192,823 B2 6/2012 Hainbach
8,302,356 B2 11/2012 Knight, III
8,381,461 B2 * 2/2013 Repasky ..... E04D 11/007 52/126.1
8,557,083 B2 10/2013 Paganelli
8,631,624 B2 1/2014 McIntosh et al.
8,898,999 B1 * 12/2014 Kugler ..... E04F 15/02464 52/126.6
9,683,375 B2 * 6/2017 Kugler ..... E04F 15/02405
9,803,377 B2 * 10/2017 Pelc, Jr. ..... E04F 15/0247
2004/0035064 A1 * 2/2004 Kugler ..... E04F 15/02183 52/126.6
2004/0261329 A1 * 12/2004 Kugler ..... E04F 15/02183 52/126.6
2006/0260223 A1 * 11/2006 Wang ..... E04F 13/0862 52/177
2008/0222973 A1 * 9/2008 Lee ..... E04F 15/02476 52/126.1
2009/0205275 A1 * 8/2009 Isaac ..... E04F 15/02458 52/263
2010/0005739 A1 * 1/2010 Pendergast ..... E04F 15/02452 52/263
2010/0051763 A1 * 3/2010 Knight, III ..... B23Q 1/0054 248/161
2010/0275531 A1 * 11/2010 Andrews ..... A01G 9/02 52/173.1
2011/0016809 A1 * 1/2011 Knight, III ..... E04D 11/007 52/263
2011/0214798 A1 9/2011 Tracy
2012/0073218 A1 * 3/2012 Zlatar ..... E04F 15/02452 52/126.6
2012/0272589 A1 * 11/2012 Kugler ..... E04F 15/02183 52/126.6
2012/0291369 A1 * 11/2012 Knight, III ..... E04D 11/007 52/126.6
2013/0022392 A1 1/2013 Eberle, III
2013/0219809 A1 * 8/2013 Tabibnia ..... E04F 15/02464 52/126.6
2014/0308076 A1 * 10/2014 Tabibnia ..... E01C 5/00 404/99
2016/0244979 A1 * 8/2016 Greaves ..... E04F 15/02452
2018/0155935 A1 * 6/2018 Gosling ..... E04B 5/48

FOREIGN PATENT DOCUMENTS

JP 02311585 12/1990
JP 5561966 7/2014
JP 2014227720 8/2014
WO 2007099572 9/2007
WO 20140006524 1/2014

OTHER PUBLICATIONS

Eternoivica Catalogue Price List, pp. 58-67, dated 2008.
Ironwoods Elevated Deck Tile Systems with Hanover Pedestals, Website retrieved Jun. 12, 2009.

* cited by examiner

RESTRAINT SYSTEM FOR ELEVATED FLOORING TILES

CROSS REFERENCE TO RELATED APPLICATIONS

This application claims priority to U.S. Patent Application No. 62/581,141, entitled RESTRAINT SYSTEM FOR ELEVATED FLOORING TILES, and filed on Nov. 3, 2017, the entire contents of which are incorporated herein in their entirety as if set forth in full.

BACKGROUND OF THE INVENTION

1. Field of the Invention

This invention relates to the field of structural systems for elevating surface materials such as for elevated floors, decks and walkways.

2. Description of Related Art

Elevated building surfaces such as elevated floors, decks, terraces and walkways are desirable in many interior and exterior environments. One common system for creating such surfaces includes a plurality of surface tiles, such as concrete tiles (pavers), stone tiles, clay tiles, ceramic tiles, wood tiles, or composite tiles, and a plurality of spaced-apart support pedestals and/or joists or stringers upon which the tiles are placed to be supported above a fixed surface. For example, in outdoor applications, the surface may be elevated above a fixed surface to promote drainage, to provide a level structural surface for walking, and/or to prevent deterioration of or damage to the surface tiles.

Various shapes of surface tiles are possible. In the case of rectangular-shaped tiles, for instance, each of the spaced-apart support pedestals can support four adjacent surface tiles at the tile corners. Stated another way, each rectangular surface tile can be supported by four pedestals that are disposed under each of the corners of the tile.

The pedestals can have a fixed height or can have an adjustable height such as to accommodate variations in the contour of the fixed surface upon which the pedestals are placed or to create desirable architectural features. Various types of support pedestals are disclosed in U.S. Pat. No. 6,363,685 to Kugler, U.S. Patent Publication No. 2004/0261329 to Kugler et al., U.S. Pat. No. 8,122,612 to Knight, III et al., and U.S. Pat. No. 8,898,999 to Kugler et al., each of which is incorporated herein by reference in its entirety. For instance, some types of support pedestals include a threaded base member and a threaded support member that is threadably engaged with the base member to enable the height of the support pedestal to be adjusted by rotating the support member or the base member relative to the other. Support pedestals can also include an extender member (e.g., a coupling or coupler member) disposed between the base member and the support member for further increasing the height of the pedestal, if necessary. Other types of support pedestals may include a base, cylindrical support (e.g., cut to size), and a cap.

SUMMARY OF THE INVENTION

In one aspect disclosed herein, an elevated flooring surface assembly includes a plurality of support apparatuses spacedly disposed upon a fixed surface, a plurality of flooring units disposed over upper surfaces of the support apparatuses to create an elevated flooring surface, and a plurality of restraint apparatuses disposed over portions of the flooring units and secured to the support apparatuses. Each flooring unit may include a support plate including a base and at least a first attachment member interconnected to the base adjacent a first of the outer edge segments; and a building surface component positioned over the support plate. Each restraint apparatus includes a base that is disposed over the top surfaces of the first attachment members of at least first and second of the flooring units and secured to the upper surface of at least one of the support apparatuses. Each restraint apparatus also includes a spacer that spaces the first and second flooring units from each other.

In another aspect disclosed herein, a method of constructing an elevated building surface includes locating a plurality of support apparatuses upon a fixed surface, a plurality of flooring units over upper surfaces of the support apparatuses, the flooring units having gaps disposed in at least one outer edge segment thereof, positioning each of a plural of restraint apparatuses between adjacent pairs of the flooring units, and securing the restraint apparatuses to the upper surfaces of the support apparatuses, where the securing includes clamping the attachment members between the restraint apparatuses and the upper surfaces of support apparatuses. The positioning step includes first sliding base members of the restraint members into the gaps of the adjacent pairs of the flooring units, and second sliding spacer members of the restraint members between the building surface components of the adjacent pairs of flooring units, where the spacer members are attached to and extend away from the base members, and where the first and second sliding occur substantially simultaneously.

Various refinements may exist of the features noted in relation to the various aspects. Further features may also be incorporated in the various aspects. These refinements and additional features may exist individually or in any combination, and various features of the aspects may be combined. In addition to the exemplary aspects and embodiments described above, further aspects and embodiments will become apparent by reference to the drawings and by study of the following descriptions.

DETAILED DESCRIPTION

Figure 1:
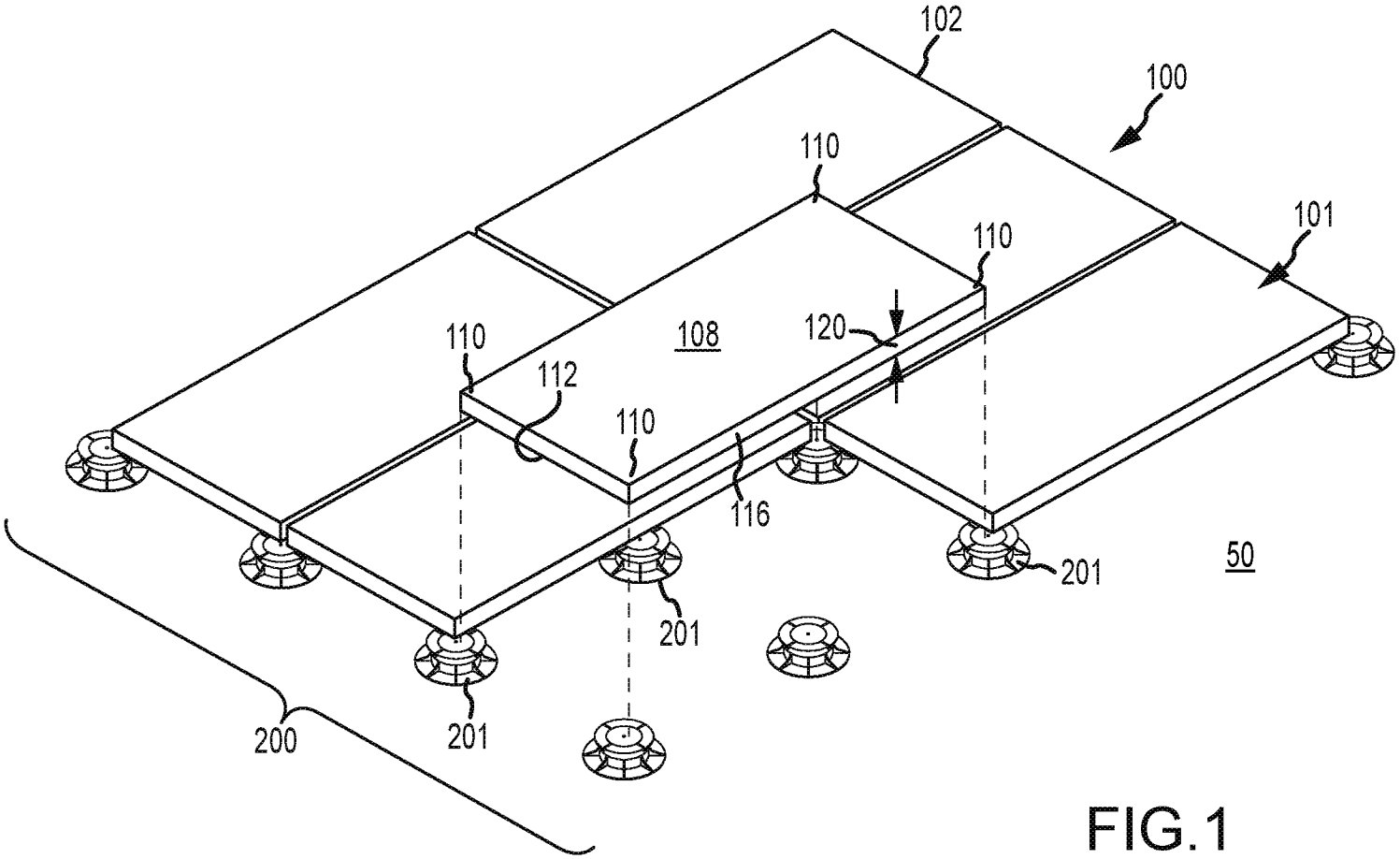
FIG. 1 is a perspective view of an interior or exterior elevated building surface assembly.

FIG. 1 illustrates a portion of an elevated building surface assembly 100 that includes a building surface 101 formed from a plurality of building surface components 102 (e.g., surface tiles, pavers, flooring units, etc.) that are elevated above a fixed surface 50 by a support structure 200 made up of a plurality of spaced-apart support members such as support pedestals 201. Each building surface component 102 may broadly include opposing top and bottom surfaces 108, 112, one or more corner portions 110, one or more outer edge segments 116 disposed between adjacent corner portions 110, and a thickness 120 between the top and bottom surfaces 108, 112. The building surface components 102 may take various shapes (e.g., rectangular as shown, square, hexagonal, and/or other shapes) and may be made from virtually any material from which a building surface is to be constructed. Examples include, but are not limited to, slate, stone, porcelain, ceramic, cement compounds, concrete, wood, metal, fiberglass, plastic, composites, combinations of the foregoing, and the like.

The support pedestals 201 can be placed in a spaced-apart relation on fixed surfaces including, but not limited to, rooftops, plazas, over concrete slabs including cracked or uneven concrete slabs or sub-floors and can be placed within fountains and water features and the like. The elevated building surface assembly 100 can be used for both interior and exterior applications. For instance, the bottom surfaces 112 of the corner portions 110 of each building surface component 102 may be placed upon several support pedestals 201 to elevate the building surface component 102 above the fixed surface. As illustrated in FIG. 1, some support pedestals 201 may be disposed beneath four corner portions 110 of adjacent building surface components 102 while other support pedestals 201 may be disposed under the outer edge segments 116 of the building surface components 102 (e.g., between the corner portions 110 and proximate to a central portion of the outer edge segment 116). Such a configuration may be desirable when using very heavy and/or very large building surface components, such as large concrete building surface components, when placing heavy objects on the elevated building surface (e.g., planters, benches, etc.), or the like. Although not illustrated, support pedestals 201 may be disposed in other locations, such as below a central portion of the building surface components 102.

The support pedestals 201 forming the support structure 200 may be height-adjustable, fixed height, or any combinations thereof (e.g., including a base, a cap, and a column that is cut to an appropriate length) and may be constructed of any appropriate materials (e.g., metals, plastics, carbon fibers, composites, etc.). Broadly, each support pedestal 201 may include a lower portion that is adapted to be placed upon a fixed surface, an upper portion for receiving a building surface component 102, and a central section extending between or otherwise interconnecting (e.g., perpendicularly) the upper and lower portions. The support pedestals 201 may be laid out in various configurations as may be dictated by the shape and size of the building surface components, such as a rectangular configuration or a triangular configuration to support rectangular or triangular building surface components.

Figure 2:
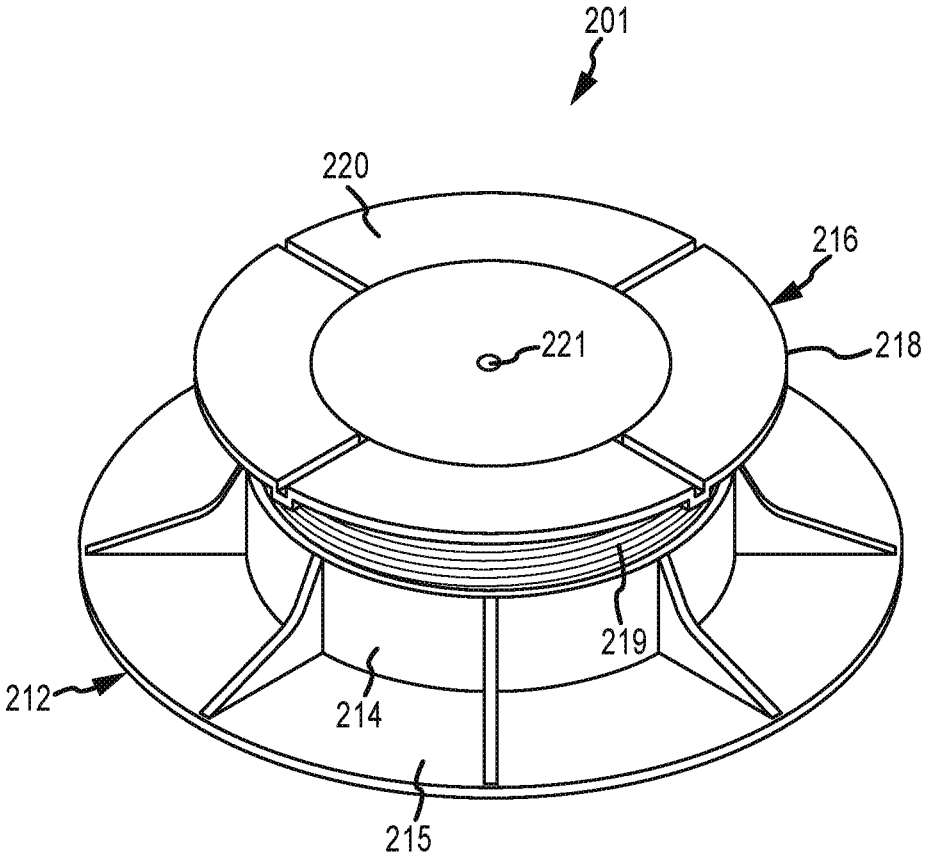
FIG. 2 is a perspective view of a support pedestal for use with the elevated building surface assembly of FIG. 1.

Turning now to FIG. 2, a support pedestal 201 (e.g., one or more of support pedestals 201 of FIG. 1) for supporting building surface components (e.g., building surface components 101 of FIG. 1) of an elevated building surface assembly (e.g., elevated building surface assembly 100 of FIG. 1) according to one embodiment is shown. Broadly, the support pedestal 201 may include a lower portion such as a base member 212 including a base plate 215 that is configured to be placed against a fixed surface (e.g., ground, rooftop, etc.) and a base extension 214 connected to the base plate 215 in any appropriate manner and extending away from the base plate 215. The support pedestal 201 may also include an upper portion such as a support member 216 including a support plate 218 having an upper or top surface 220 over which building surface components 102 are configured to be placed and support extension 219 connected to the support plate 218 in any appropriate manner and extending away from the support plate 218.

As shown in FIG. 2, the base and support extensions 214, 219 may be threadably engageable with each other to allow the height of the support pedestals 201 (i.e., the distance between the base and support plates 215, 218) to be adjusted. For instance, the base extension 214 may be in the form of a hollow cylindrical member having a threaded inner surface and the support extension 219 may be in the form of a cylindrical member having a threaded outer surface that is configured to be threadably received inside the base extension 214 (or vice versa). The base and support extensions 214, 219 may collectively form a "central section" of the support pedestal 201. In some arrangements, one or more coupling members may be incorporated between the base and support extensions 214, 219 to allow for increased heights of the support pedestal 201 (e.g., such as that disclosed in U.S. Pat. No. 8,156,694 which is incorporated herein by reference as if set forth in full). In other arrangements, the support pedestal 201 may have a fixed height, such as where the base and support plates 215, 218 are fixedly attached together by one or more rigid members that are not adjustable relative to each other.

Figure 3:
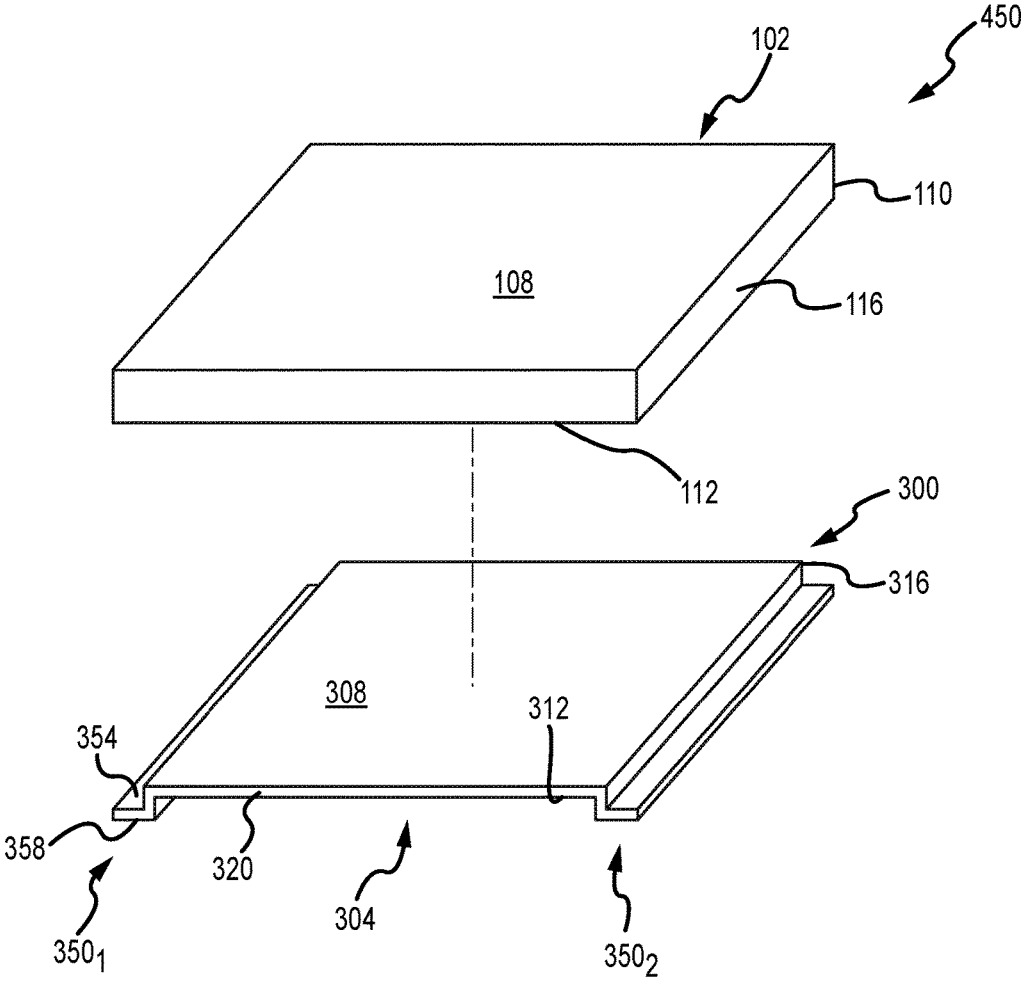
FIG. 3 is an exploded perspective view a flooring unit for use in the elevated building surface assembly of FIG. 1.
Figure 4:
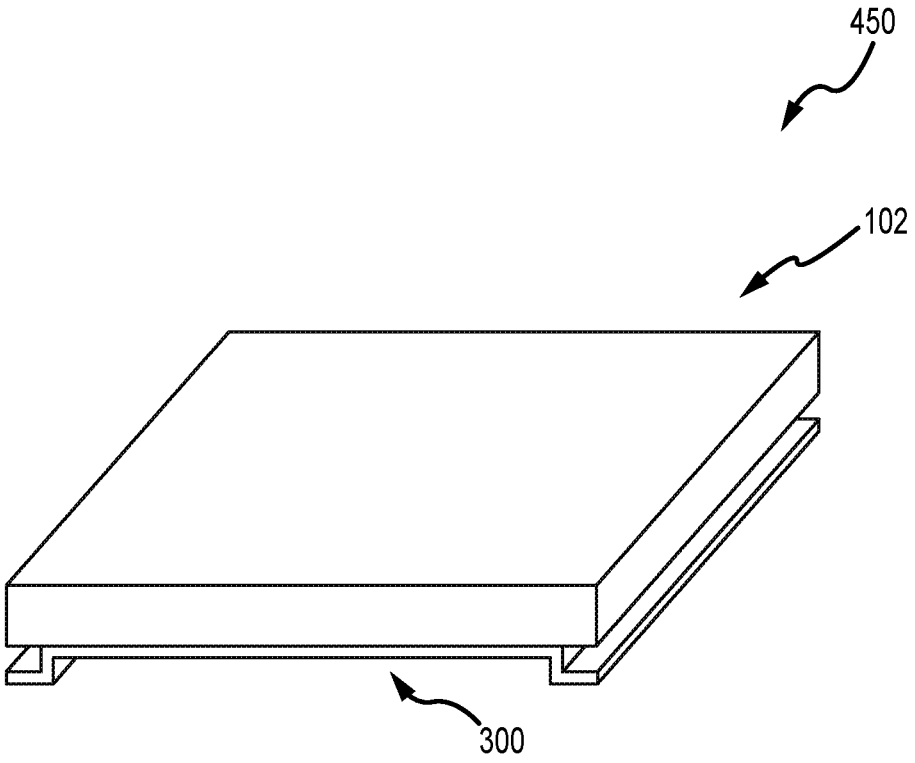
FIG. 4 is a perspective view of flooring unit of FIG. 3.
Figure 5:
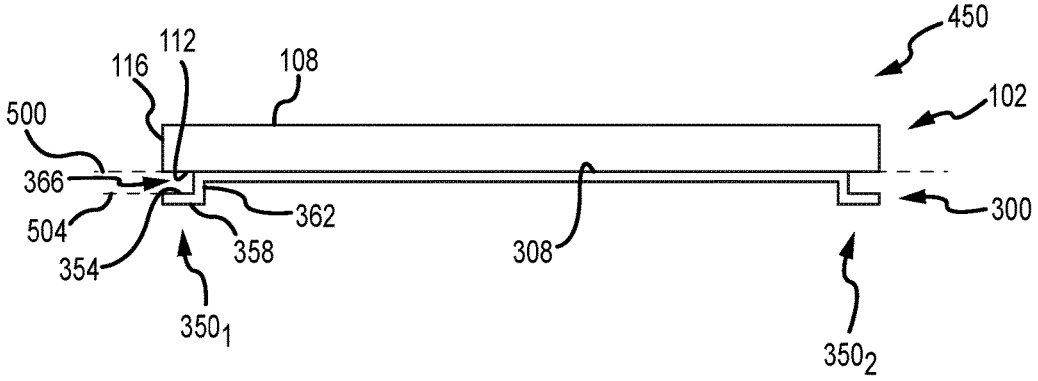
FIG. 5 is a front view of the flooring unit of FIG. 4.

With reference now to FIGS. 3-5, one embodiment of a support plate 300 is illustrated that is configured to provide additional support for the building surface components 102 of the elevated building surface assembly 100, reduce the potential for dropping or falling of the building surface components 102 or portions thereof in case of fracture or cracking of the building surface components 102 (e.g., towards or to the fixed surface), facilitate proper location of the building surface components 102 over the support pedestals 201 to create the building surface 101, and increase the overall durability of the elevated building surface assembly 100. The building surface component 102 and support plate 300 (or in some embodiments just a building surface component 102 alone) may be considered a flooring unit 450.

Broadly, the support plate 300 may include a body or base 304 with opposite top and bottom surfaces 308, 312, a plurality of corners or corner portions 316, and a plurality of outer edge segments 320 between adjacent corner portions 316, where the corner portions 316 and outer edge segments 320 collectively form an outer periphery or perimeter of the support plate 300. The base 304 may generally be in the form of a planar member that serves as a barrier between a building surface component 102 laid over (e.g., affixed thereto or freely laid thereover) the top surface 308 of the base 304 and the fixed surface below the building surface components 102 and that serves to inhibit movement of the building surface component 102 (or portions thereof) downwardly in a direction towards or to the fixed surface (e.g., and in some cases upwardly, such as when the building surface component 102 is affixed to the support plate 300 in any appropriate manner). In one arrangement, the base 304 may be free of or substantially free of any apertures therethrough between the top and bottom surfaces 308, 312 (e.g., to reduce the likelihood of passage of one or more portions of a building surface component 102 therethrough). The base 304 may be made of any appropriate material such as metal, plastic, wood, a cement-compound, concrete, clay, fiberglass, rubber, a composite material, one or more combinations of any of the aforementioned, or the like.

The bottom surface 112 of the building surface component 102 may be secured to the top surface 308 of the base 304 of the support plate 300 in any appropriate manner to form the flooring unit 450 (e.g., where the building surface component 102 and support plate 300 are non-movable relative to each other). In one arrangement, at least one adhesive (not shown) may be disposed (e.g., applied, placed, etc.) onto the top surface 308 of the support plate 300 and/or onto the bottom surface 112 of the building surface component 102 and then the building surface component 102 may be placed over the support plate 300 so that the at least one adhesive secures or bonds the building surface component 102 to the support plate 300 and thereby further increases the overall durability of the elevated building surface assembly 100 and the like.

In one embodiment, the at least one adhesive may be in at least a semi-solid or substantially solid state during the disposing step. For instance, the at least one adhesive may be in the form of one or more adhesive strips (e.g., where each of opposing first and second surfaces of the adhesive strips are adhesive or tacky) of any appropriate material (e.g., butyl rubber, as just one example) and of any appropriate dimensions (e.g., width, length, thickness) to cover at least a portion of the surface area of the top surface 308 of the support plate 300 and/or the bottom surface 112 of the building surface component 102 (e.g., at least about 5% of the surface area; not greater than about 95% of the surface area; etc.). As an example, such adhesive strips or portions may be the same as or similar to those disclosed in U.S. Pat. App. Pub. No. 2017/0138066, which is assigned to the assignee of the present application, and which is incorporated herein by reference in its entirety.

In another embodiment, the at least one adhesive may be in a fluid state when it is applied to the top surface 308 of the support plate 300 and/or the bottom surface 112 of the building surface component 102 and then be allowed to solidify (e.g., through drying, heat, cooling, etc.) after the building surface component 102 is placed onto the support plate 300 to secure the building surface component 102 to the support plate 300. In one arrangement, the at least one adhesive may include any appropriate organic or inorganic adhesive. As one example, the at least one adhesive may be in the nature of a non-reactive adhesive such as a drying-type adhesive. For instance, the at least one adhesive may be a solvent-based adhesive (e.g. mixture of polymers dissolved in a solvent) where the adhesive hardens or solidifies as the solvent evaporates to secure the surface tiles to the support plates (e.g., such that the adhesive is substantially free of solvents after the adhesive has solidified). As another example, the adhesive may be in the form of a water-based (waterborne) adhesives, such as formulated from natural or synthetic polymers. As a further example, the at least one adhesive may be a hot adhesive (e.g., hot melt adhesive) such as a thermoplastic applied in molten form which solidifies on cooling to bond the building surface components 102 to the support plates 300. As a still further example, the at least one adhesive may be in the form of a reactive adhesive such as a one-part adhesive that hardens via a chemical reaction with an external energy source (e.g., radiation, heat, moisture), a multi-component or part adhesive that hardens by mixing together two or more components that chemically react, or the like.

The support plate 300 may also include at least one attachment member 350 interconnected to the base 304 such as first and second opposite attachment members 3501, 3502 interconnected to opposite first and second sides of the base 304. Broadly, each attachment member 350 is configured to facilitate placement of the flooring unit 450 over the upper surface of a support apparatus such as the upper surface 220 of a support pedestal 201 and attachment of the flooring unit 450 to the support member to inhibit movement of the flooring unit 450 away from the support member in the case of a wind uplift event or the like. Specifically, each attachment member 350 may include a bottom surface 358 that is configured to be placed over or against the upper surface 220 of a support pedestal 201 or the like and an opposite top surface 354 that is configured to receive a clamping force from a restraint apparatus 600 to secure the flooring unit 450 to the support pedestal 201 as discussed in more detail below. In one arrangement, the first attachment member may be disposed outside of the outer periphery of the base 304.

In one embodiment, the top surface 308 of the base 304 may generally reside in a first reference plane 500 and the top surface 354 of each attachment member 350 may generally reside in a second reference plane 354 that is between the first reference plane 500 and the bottom surface 358. As just one example, each attachment member 350 may be spaced from the base 304 by at least one spacing member 362 that extends away from the base 304 and away from a building surface component 102 secured to the top surface 308 of the base 304. When the building surface component 102 is selected to have a width or cross-dimension that extends past the outer periphery of the base and over the attachment member 350, this arrangement advantageously creates a gap 366 (e.g., slot, elongated opening, etc.) between the bottom surface 112 of the building surface component 102 and the top surface 354 of the attachment member 350 into which a restraint apparatus 600 can be inserted and along which the restraint apparatus 600 can slide.

In one embodiment, the support plate 300 may initially be in the form of a single sheet of material (e.g., metal) that is appropriately bent or otherwise manipulated to form the base 304, spacing member(s) 362, and attachment member(s) 352. In the embodiment shown in FIGS. 3-11, each attachment member 350 is disposed outside of the outer periphery of the base 304. In other embodiments, the support plate 300 may be in the form of two or more pieces. In any case, the disclosed arrangement advantageously allows for the creation of a gap (i.e., gap 366) for receipt of one or more restraint apparatuses (e.g., restraint apparatus(es) 600) free of having to physically carve or otherwise create a notch, opening, gap or the like in the building surface component 102.

Figure 6:
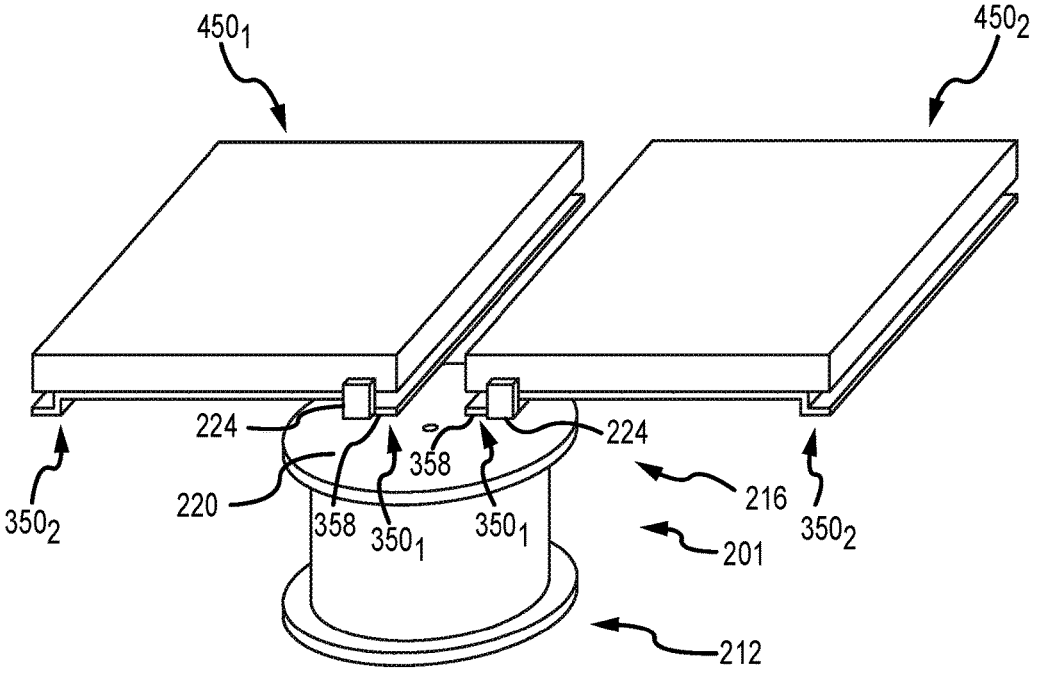
FIG. 6 illustrates first and second of the flooring units of FIG. 4 being disposed over a support apparatus.

FIG. 6 illustrates corner portions of first and second flooring units $\mathbf{450}_1$, $\mathbf{450}_2$ being placed over the upper surface 222 of a support pedestal 201. More specifically, the lower surfaces 358 of first attachment members 3501 of the first and second flooring units $\mathbf{450}_1$, $\mathbf{450}_2$ are disposed over the upper surface 222 of the support pedestal 201. In one arrangement, the support pedestal 201 may include one or more spacers 224 extending upwardly from or relative to the upper surface 222 that serve to initially locate the first and second flooring units $\mathbf{450}_1$, $\mathbf{450}_2$ over the upper surface 222 (e.g., by way of disposing the corner portions of the first and second flooring units $\mathbf{450}_1$, $\mathbf{450}_2$ over the upper surface 222 and urging the corner portions or the attachment members 350 against the spacers 224) and space the first and second flooring units $\mathbf{450}_1$, $\mathbf{450}_2$ from third and fourth (or additional) flooring units or building surface components placed over the upper surface (e.g., see FIG. 10).

Figure 7:
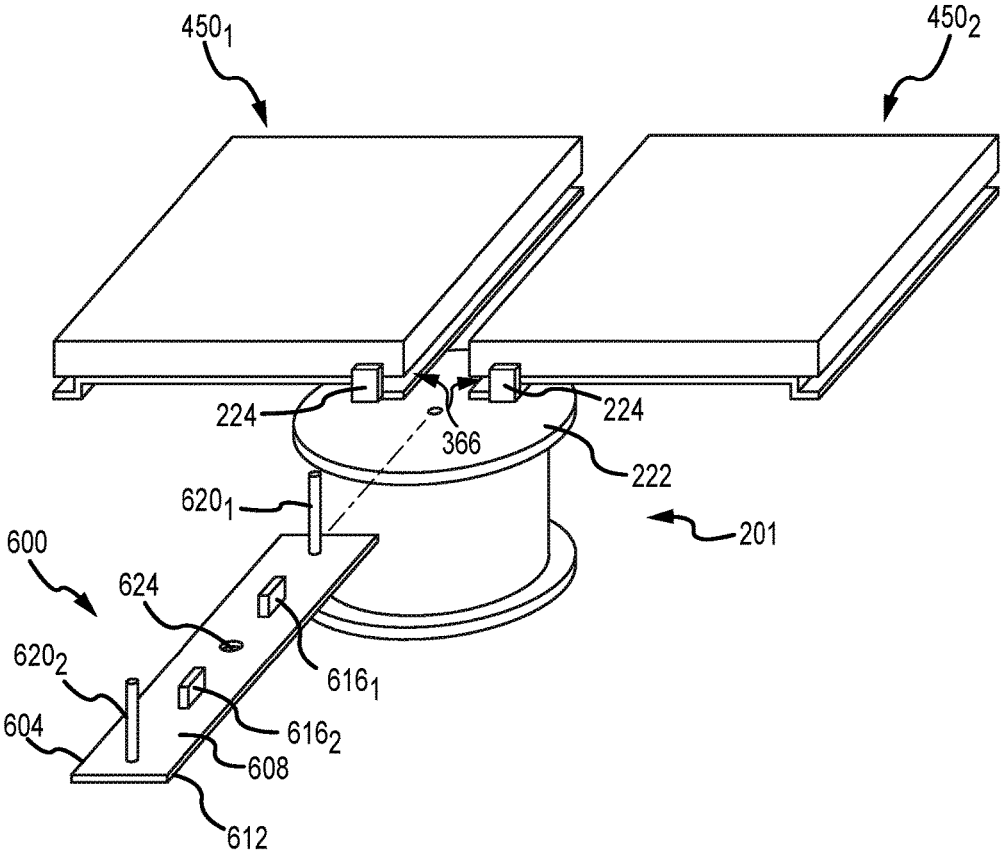
FIG. 7 is similar to FIG. 6 but additionally illustrating a restraint apparatus for insertion between the first and second flooring units.

Turning now to FIG. 7, one embodiment of a restraint apparatus 600 is illustrated that may be used with the flooring units 450 to secure the flooring units 450 to the support pedestals 201 or other support apparatuses. Broadly, the restraint apparatus 600 is configured to be appropriately positioned between the first and second adjacent flooring units $\mathbf{450}_1$, $\mathbf{450}_2$ and over the attachment members 350 and then secured to the support pedestal 201 to thereby secure the first and second adjacent flooring units $\mathbf{450}_1$, $\mathbf{450}_2$ to the support pedestal. As shown, the restraint apparatus 600 includes a base member 604 having opposite top and bottom surfaces 608, 612 and at least one spacer member 616 extending upwardly away from the base member 604. For instance, the base member 604 may be in the form of a spline member (e.g., flat plate or strip) that is configured to be received within the gaps 366 and over the upper surfaces 354 of the attachment members 350 of the first and second adjacent flooring units $\mathbf{450}_1$, $\mathbf{450}_2$. The restraint apparatus 600 may be constructed from any appropriate material(s) such as at least one of metal, plastics, wood, dense microfiber composites, reinforced composites, and/or the like. In one embodiment, the restraint apparatus 600 may be in the form of a single, unitary structure such as any appropriate gauge, length and width of sheet metal, plastic, or the like.

To facilitate the reader's understanding of how flooring units 450 and restraint apparatuses 600 may be incorporated and used within an elevated building surface assembly 100 in a manner that restricts upward movement or lifting of flooring units 450 (e.g., in response to wind blowing underneath or across the flooring units 450), one method 800 of constructing an elevated building surface assembly 100 at a particular site of interest will now be discussed. As initially shown in FIG. 12, the method 800 may include locating 804 a plurality of support apparatuses such as support pedestals 201 upon a fixed surface 50 (e.g., ground, rooftop, etc.) at the site with any appropriate (e.g., predetermined) spacing between the support pedestals 201. See FIG. 1.

For instance, any appropriate number of fixed and/or adjustable-height support pedestals 201 may be used and may be selected or configured so that the upper surfaces 220 of at least some adjacent ones of the support pedestals 201 are substantially coplanar. As one example, the upper surfaces 220 of all of the support pedestals 201 may be coplanar. As another example, however, the elevated building surface assembly 100 may be constructed so that the building surface 101 has two or more portions (e.g., levels) at different heights relative to a fixed reference plane that is parallel to surfaces of the multiple levels. Thus, in another arrangement, the upper surfaces 220 of a first group of adjacent support pedestals 201 may reside in a first plane while the upper surfaces 220 of a second group of adjacent support pedestals 201 may reside in a second plane, where the first and second planes are at different heights from a fixed third reference plane that is parallel to the first and second planes.

The method 800 may then include placing 808 flooring units 450 over the upper surfaces 220 of the support apparatuses such as by placing each respective corner portion of each flooring unit 450 over the upper surface 220 of a different respective support pedestal 201. The upper surface 220 of each support pedestal 201 may thus support the corner portions of a plurality of flooring units 450. For instance, FIG. 6 illustrates a support pedestal 201 supporting first and second flooring units $\mathbf{450}_1$, $\mathbf{450}_2$ (it being understood that the other corner portions of the first and second flooring units $\mathbf{450}_1$, $\mathbf{450}_2$ would also be supported by support apparatuses such as support pedestals 201).

Figure 8:
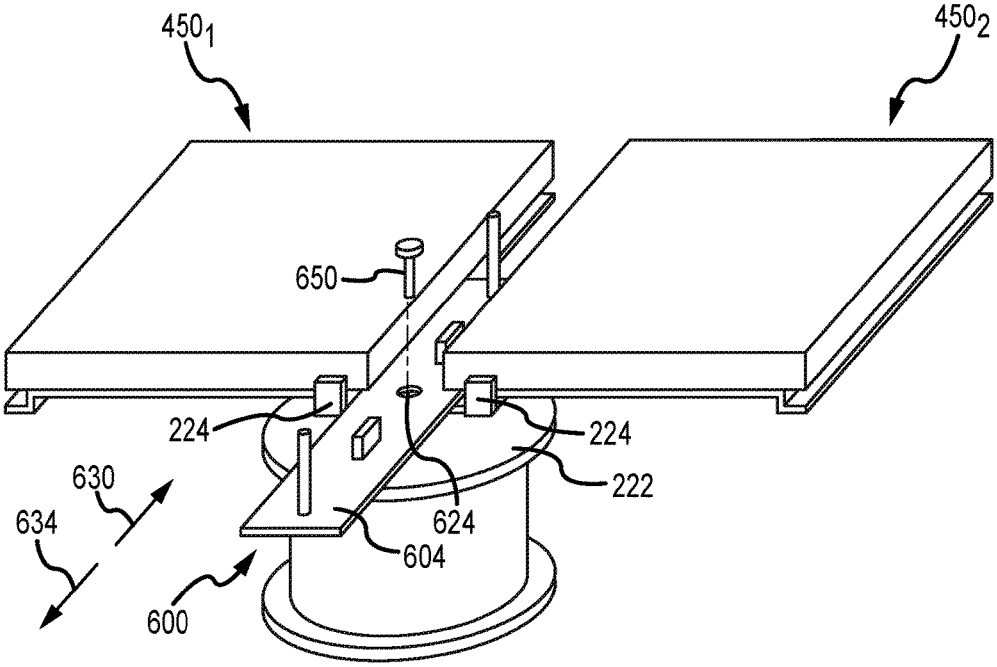
FIG. 8 is similar to FIG. 7, but illustrating the restraint apparatus being inserted between the first and second flooring units.
Figure 12:
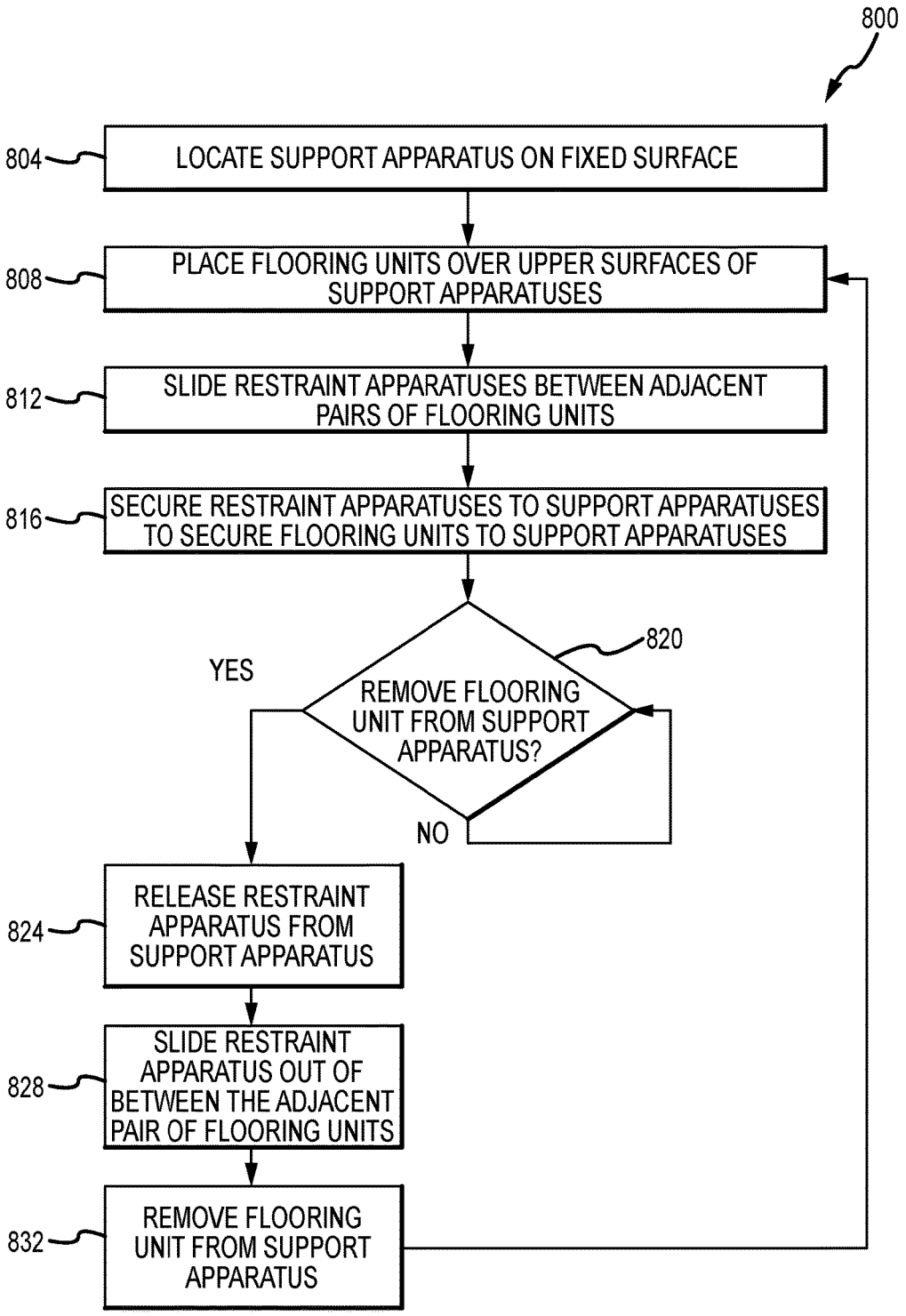
FIG. 12 is a flow diagram of a method of constructing an elevated building surface.

As shown in FIG. 12, the method 800 may then include sliding 812 or otherwise positioning restraint apparatuses 600 between adjacent pairs of flooring units 450. With reference to FIGS. 7-8, for instance, each restraint apparatus 600 may be positioned between the first and second flooring units $\mathbf{450}_1$, $\mathbf{450}_2$ such that the base member 604 slides into the gaps 366 of the first and second flooring units $\mathbf{450}_1$, $\mathbf{450}_2$ and such that the at least one spacer member 616 slides (e.g., simultaneously) between opposing outer edges of the first and second flooring units $\mathbf{450}_1$, $\mathbf{450}_2$ (such as between opposing outer edge segments 116 of the building surface components 102 of the first and second flooring units $\mathbf{450}_1$, $\mathbf{450}_2$). In one arrangement, the first and second flooring units $\mathbf{450}_1$, $\mathbf{450}_2$ may be pushed towards each other so as to abut or closely abut the at least one spacer member 616. Compare FIGS. 8 and 9.

After the sliding 812 step, the method 800 may include securing 816 the restraint apparatuses 600 to the support apparatuses to secure the flooring units 450 to the support apparatuses. With reference to FIG. 8, for instance, any appropriate fastener 650 (e.g., threaded fastener) may be inserted through the body 604 of the restraint apparatus 600 and into the upper surface 220 of the support pedestal 201 so as to press the body 604 of the restraint apparatus against the upper surfaces 354 of the attachment members 350 of the first and second flooring units $\mathbf{450}_1$, $\mathbf{450}_2$ (and thereby clamp the attachment members 350 between the restraint apparatus 600 and the upper surface 220 of the support pedestal 201). For instance, the fastener 650 may be inserted through an aperture 624 in the body 604 and threaded into the upper surface 220 of the support pedestal 201. In one arrangement, the aperture 624 may have a threaded nut or the like molded therein to inhibit inadvertent loosening of the fastener 650 from the support pedestal 201 and the restraint apparatus 600. At this point, the first and second flooring units $\mathbf{450}_1$, $\mathbf{450}_2$ are secured to the support pedestal 201 and thus restricted against upward movement away from the support pedestal 201 and away from the fixed surface 50.

Figure 9:
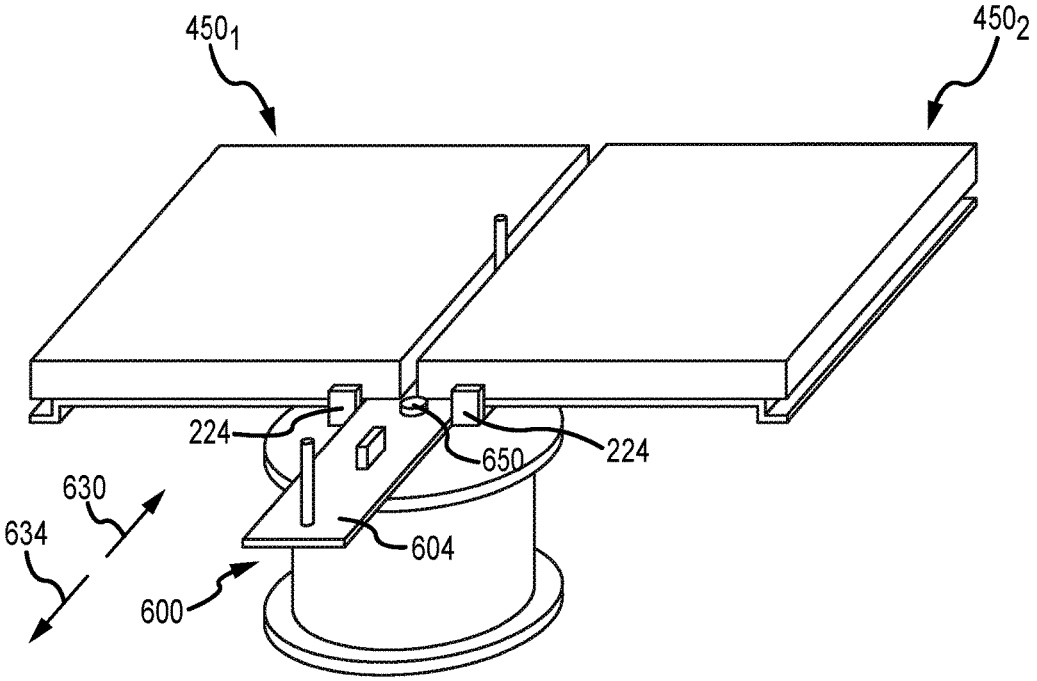
FIG. 9 is similar to FIG. 8, but illustrating the first and second flooring units being pressed against the restraint apparatus.
Figure 10:
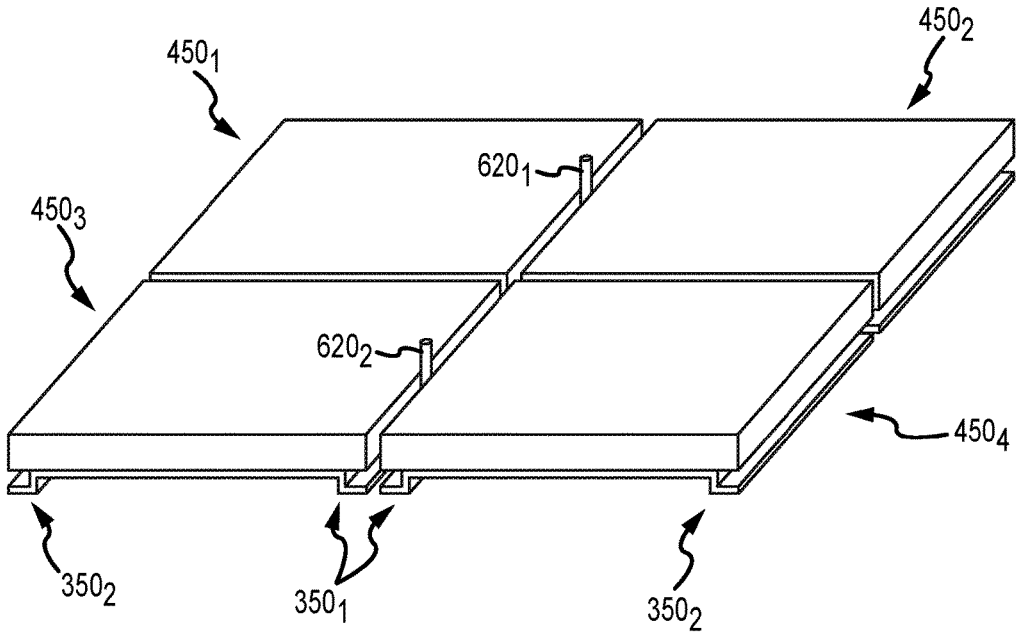
FIG. 10 is similar to FIG. 9, but additionally illustrating third and fourth flooring units being disposed over the support apparatus.

While FIG. 9 illustrates the restraint apparatus 600 being used to secure the first and second flooring units $\mathbf{450}_1$, $\mathbf{450}_2$ to the support pedestal 201, the restraint apparatus 600 may also be used to secure additional flooring units 450 to the same support pedestal 201. As an example, FIG. 10 illustrates third and fourth flooring units $\mathbf{450}_3$, $\mathbf{450}_4$ being secured to the support pedestal with the restraint apparatus 600. For instance, and with reference back to FIGS. 8-9 before the restraint apparatus 600 is secured to the upper surface 220 of the support pedestal 201, the restraint apparatus 600 may be slid in a first direction 630 such that it is fully or substantially disposed between or surrounded by the first and second flooring units $\mathbf{450}_1$, $\mathbf{450}_2$. Corners of the third and fourth flooring units $\mathbf{450}_3$, $\mathbf{450}_4$ may then be positioned over the support pedestal 201 such that their attachment members 350 are disposed over the upper surface 220 of the support pedestal 201. Part of this process may include urging the third and fourth flooring units $\mathbf{450}_3$, $\mathbf{450}_4$ against the spacer members 224 of the upper surface 220.

Figure 17:
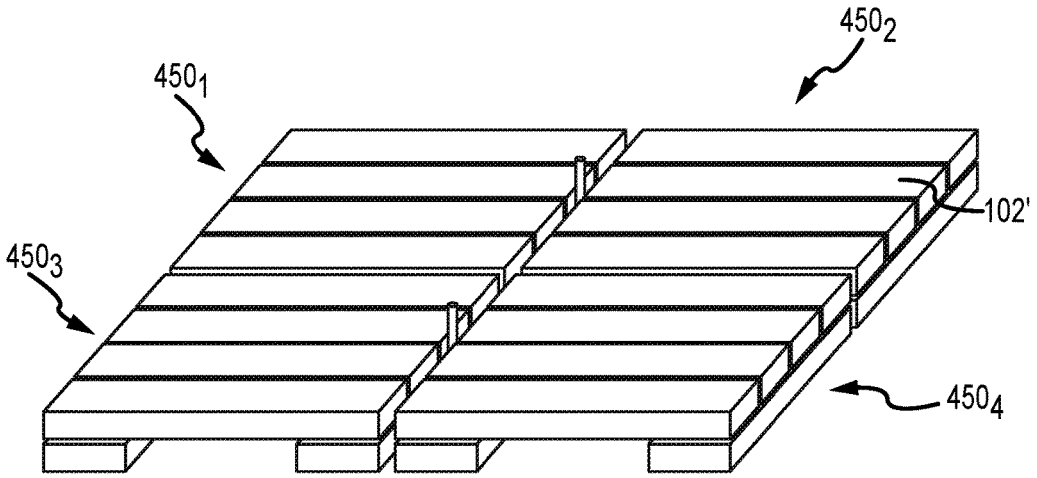
FIG. 17 illustrates a similar to FIG. 10 but including flooring units according to another embodiment.

Thereafter, the restraint apparatus 600 may be slid in an opposite second direction 634 between the third and fourth flooring units $\mathbf{450}_3$, $\mathbf{450}_4$ such that the body 604 slides into the gaps 366 of the third and fourth flooring units $\mathbf{450}_3$, $\mathbf{450}_4$ and another spacer 616 of the restraint member 600 (e.g., second spacer member $\mathbf{616}_2$) also slides between outer edges of the third and fourth flooring units $\mathbf{450}_3$, $\mathbf{450}_4$ (e.g., outer edge segments 116 of the building surface components 102 of the third and fourth flooring units $\mathbf{450}_3$, $\mathbf{450}_4$). The restraint member 600 may be slid until the aperture 624 (if included) aligns with a corresponding location over the upper surface 220 of the support pedestal (e.g., such as the center point of the upper surface 220). If necessary, the third and fourth flooring units $\mathbf{450}_3$, $\mathbf{450}_4$ may be urged towards each other so as to but the second spacer member $\mathbf{616}_2$. At this point, the top surface 608 of the base member 604 of the restraint member 600 is disposed below the bottom surfaces 112 of the building surface components 102 of the first, second, third and fourth flooring units $\mathbf{450}_1$, $\mathbf{450}_2$, $\mathbf{450}_3$, $\mathbf{450}_4$. FIG. 17 presents an arrangement similar to that in FIG. 10 but with flooring units 450' according to another embodiment (e.g., including wooden building surface components.

In one arrangement, the restraint member 600 may include one or more handle members 620 (e.g., first and second handle members 6201, 6202) attached to and extending away from the base member 604 to facilitate placement of the restraint member 600. For instance, each handle member 620 may be in the form of a post having a diameter the same as or smaller than a thickness of the spacer members 616 and a height configured to protrude above the top surface 108 of the building surface components 102 of the flooring units 450. In use, a user may grasp one or more of the handle members 620 and push or pull the restraint member 600 to a desired position. Once no further adjustments of the restraint member 600 are desired and the restraint member 600 has been secured to the upper surface 220 of the support pedestal 201, the handle members 620 may in some arrangements be pressed, deformed, or twisted and then removed. See FIG. 11. For instance, the handle members 620 may be made of a frangible material, the connection between the handle members 620 and the base member 604 may be weakened in any appropriate manner, and/or the like.

Figure 11:
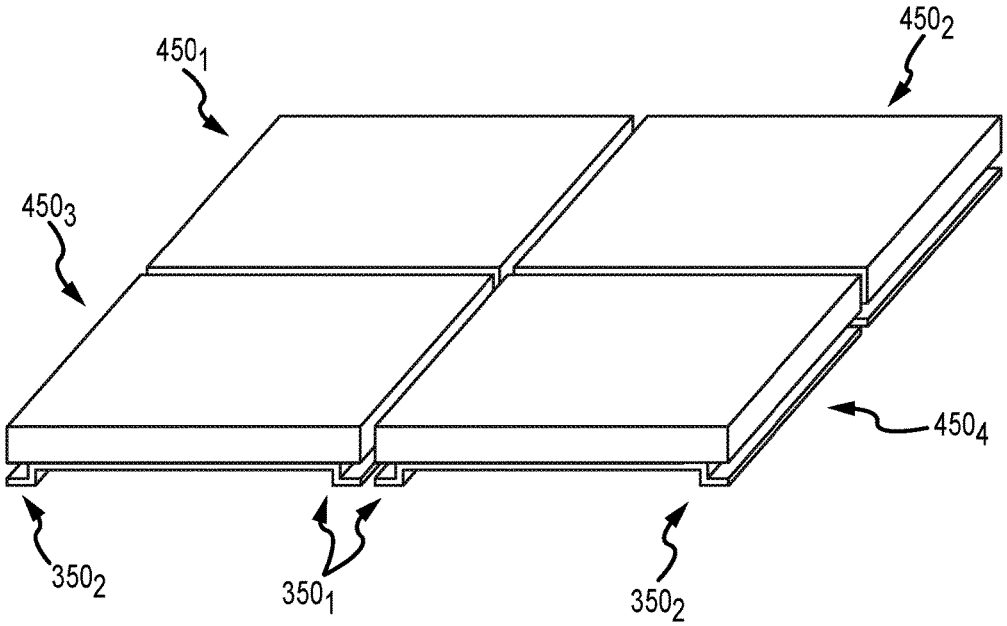
FIG. 11 is similar to FIG. 10, but illustrating handle members of the restraint apparatus being removed from view.

Turning back to FIG. 12, the method 800 may query 820 whether a flooring unit needs to be removed from a support apparatus. With reference to FIG. 11, for instance, it may be determined that the fourth flooring unit $\mathbf{450}_4$ needs to be (temporarily) removed from the support pedestal 201. In this regard, a worker may release 824 the restraint member 600 from the support pedestal 201 by way of, for instance, inserting any appropriate tool (e.g., screwdriver) between the adjacent corners of the flooring units 450 and manipulating (e.g., unscrewing) the fastener from the upper surface 220 of the support pedestal 201 and the restraint apparatus. The worker may slide 828 the restraint apparatus in the first direction 630 (see FIG. 9) until the restraint apparatus 600 is substantially fully disposed between the first and second flooring units $\mathbf{450}_1$, $\mathbf{450}_2$ and no longer disposed between the third and fourth flooring units $\mathbf{450}_3$, $\mathbf{450}_4$ (e.g., no longer over the attachment member 350 of the fourth flooring unit $\mathbf{450}_4$). For instance, the worker may urge the tool (or a different tool) against the restraint apparatus 600 (e.g., against a spacer member 616) to slide the same.

The worker may similarly loosen and slide any other restraint apparatuses 600 away from the fourth flooring unit $\mathbf{450}_4$ such as another restraint apparatus 600 disposed within the gaps 366 of the first attachment members 3501 of the third and fourth flooring units $\mathbf{450}_3$, $\mathbf{450}_4$ over another support pedestal 201, another restraint apparatus 600 disposed within the gaps 366 of the second attachment members 3502 of the second and fourth flooring units $\mathbf{450}_2$, $\mathbf{450}_4$ over another support pedestal 201, and/or the like. Once the one or more restraint apparatuses 600 are slid or otherwise moved away from the attachment members 350 of the fourth flooring unit $\mathbf{450}_4$, the fourth flooring unit $\mathbf{450}_4$ may be removed 832 from the support apparatus (e.g., from the support pedestals 201 over which it is disposed). Any other flooring units 450 of the building surface assembly may similarly be removed and replaced.

Figure 13:
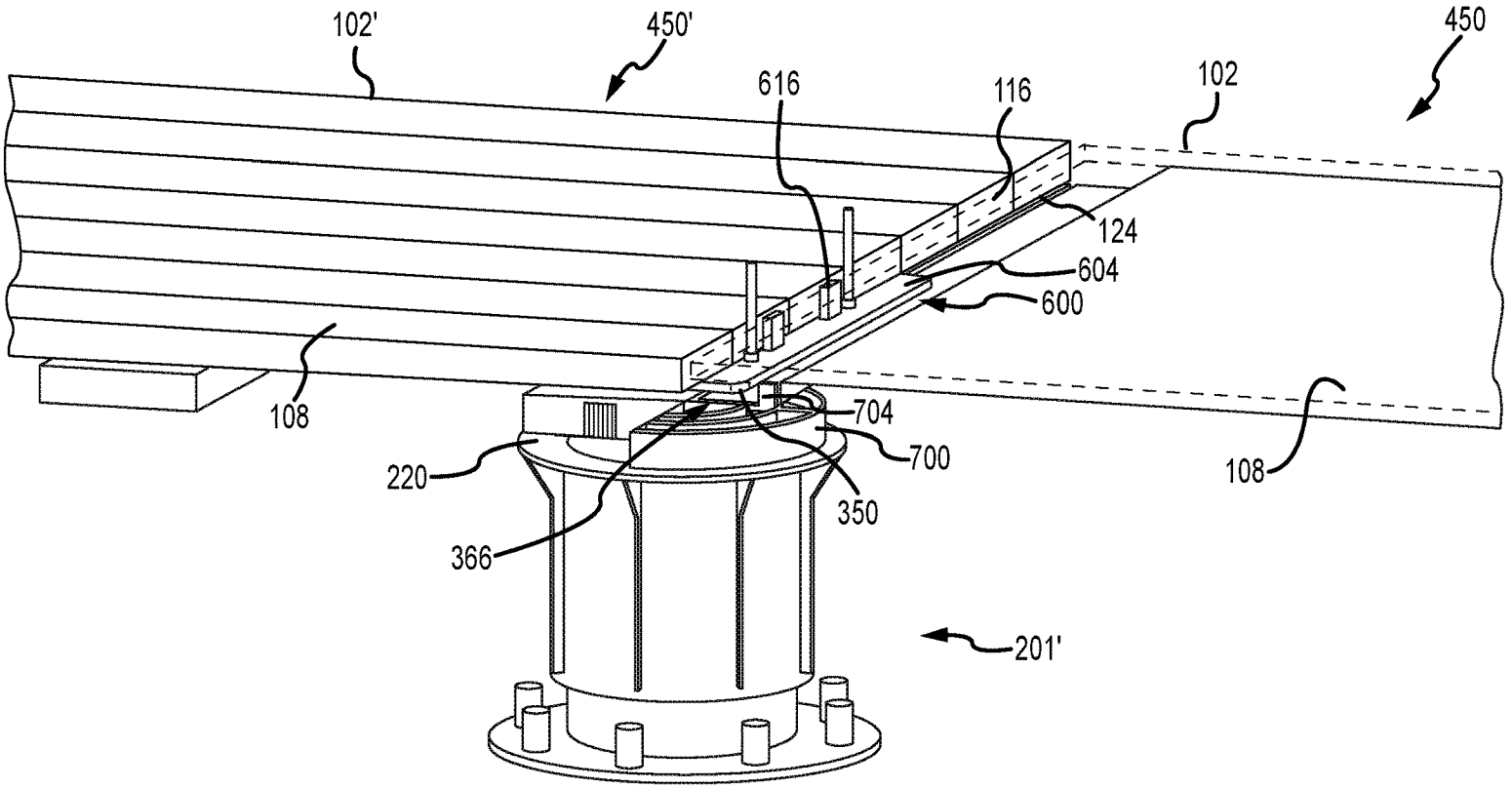
FIG. 13 illustrates another embodiment of an elevated building surface assembly.

FIG. 13 presents a portion of another embodiment of an elevated building surface assembly and illustrates how the restraint apparatuses 600 can be used to simultaneously secure and/or restrain different types of flooring units and/or building surface components. For instance, the corner portions of a flooring unit 450 as discussed above (with its building surface component 102 being shown in phantom lines in the interest of clarity) and a flooring unit 450' including a building surface component 102' (e.g., wooden components such as one of those disclosed in U.S. Pat. App. Pub. No. 2015/0308126, assigned to the Assignee of the present application, and incorporated herein in its entirety) may each be disposed over the upper surface 220 of a support pedestal 201. In one arrangement, one or more spacing apparatuses 700 may be disposed over the upper surface 220 of the support pedestal on which the flooring unit 450 is then disposed to level the upper surface 108 of the flooring unit 450 with the upper surface 108 of the flooring unit 450'. For instance, the spacing apparatus 700 may include one or more spacer members 704 protruding from an upper portion thereof that are configured to space the flooring unit 450 from an adjacent flooring unit 450, 450'.

In any event, a restraint apparatus 600 may be slid or otherwise positioned between the flooring units 450, 450' such that the base member 604 slides into the gap 366 of the flooring unit 450 (and over the attachment member 350) and into an opening or gap 124 disposed in an outer edge segment 116 of the flooring unit 450'. Simultaneously, at least one spacer member 616 of the restraint apparatus 600 slides between an outer edge of the flooring unit 450 and the outer edge segment 116 of the flooring unit 450'. In one arrangement, the restraint member 600 may remain in the position illustrated in FIG. 13 in use such that it is not secured to the upper surface 220 of the support pedestal 201' yet still restrains relative movement between the flooring units 450, 450'. In another arrangement, the restraint member 600 may be slid from its position illustrated in FIG. 13 such that it is substantially centered over the upper surface 220 of the support pedestal 201' whereby it may be secured thereto (e.g., via threading a fastener through the base 604 of the restraint member 600 and into the upper surface 220 of the support pedestal 201'.

Figure 14:
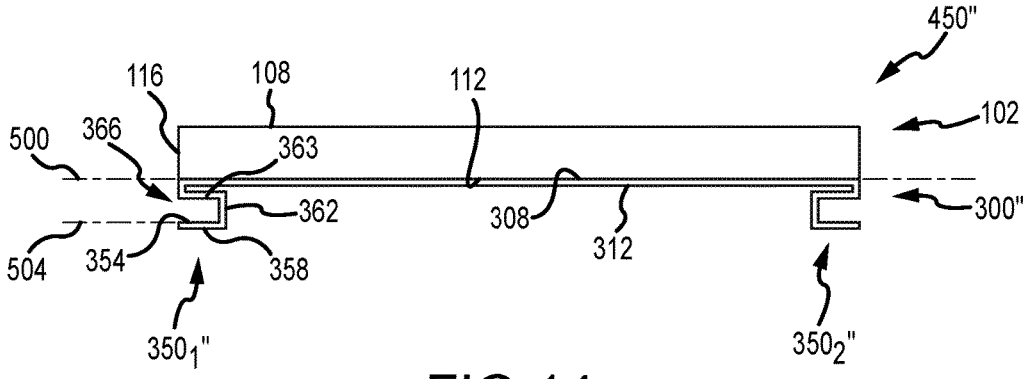
FIG. 14 illustrates a flooring unit according to another embodiment.

FIG. 14 illustrates another embodiment of a flooring unit 450" that may be used with the restraint members 600 disclosed herein. As shown, a series of folds or bends may be created adjacent outer edge segments of the support plate 300" so as to create the attachment member 350 along with a spacing member 362 and a support member 363 that is folded towards the bottom surface 312 of the support plate 300. This arrangement advantageously allows a substantial entirety of the lower surface 112 of the building surface component 102 to rest on and be supported by the top surface 308 of the base 304 of the support plate 300 and strengthens the flooring unit 450'

Figure 15:
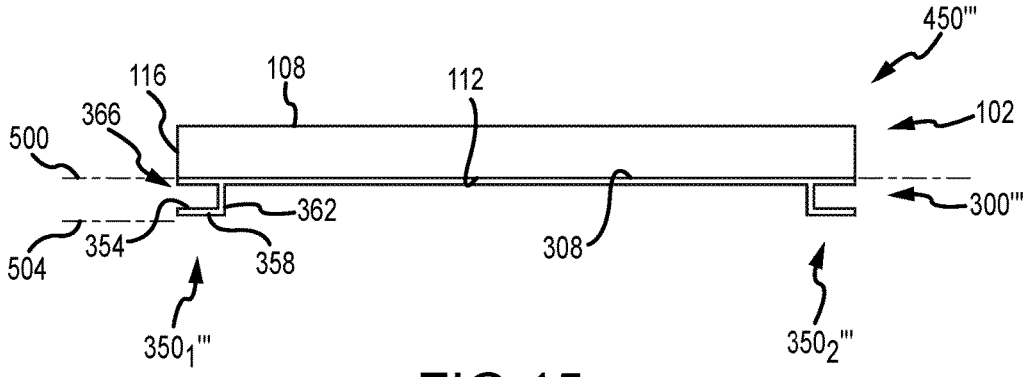
FIG. 15 illustrates a flooring unit according to another embodiment.

FIG. 15 illustrates another embodiment of a flooring unit 450'" that may be used with the restraint members 600 disclosed herein. In this embodiment, each attachment member 350 may be a separate piece of material that is appropriately rigidly attached or otherwise secured to the base 304 of the support plate 300'" a distance in from an outer edge of the base 304. This arrangement advantageously allows a substantial entirety of the lower surface 112 of the building surface component 102 to rest on and be supported by the top surface 308 of the base 304 of the support plate 300 and strengthens the flooring unit 450'.

Figure 16:
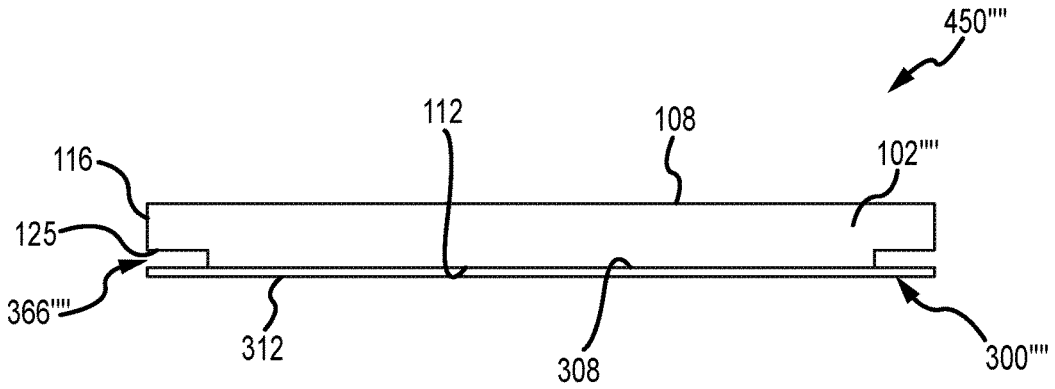
FIG. 16 illustrates a flooring unit according to another embodiment.

FIG. 16 illustrates another embodiment of a flooring unit 450'" that may be used with the restraint members 600 disclosed herein. In this embodiment, the support plate 300'" may be in the form of a substantially flat or planar member and the building surface component 102"" may have notches formed (in any appropriate manner) in the bottom surface 112 adjacent one or more of the outer edge segments 116. In this regard, upon securement of the bottom surface 112 of the building surface component 102"" to the top surface 308 of the support plate 300"", gaps 366"" may be automatically formed into which restraint members 366 may be inserted as discussed herein for securement of the flooring unit 450"" to a support pedestal or other support structure.

In one arrangement, a flooring unit similar to that disclosed in FIG. 16 is envisioned but without the notches 125 being formed in the building surface component 102"". Furthermore, the support plate 300"" and/or the building surface component 102"" may be constructed or selected so that the outer edge segments of the support plate 300"" extend past the outer edge segments 116 of the building surface component 102"" such that the top surface 308 of the support plate 300"" is not covered by the building surface component 102"" over such portions. When used with the restraint members 600 disclosed herein, the restraint members may be disposed over such exposed portions of the support plate 300"" to secure the flooring unit 450"" to the underlying support structure.

The various disclosed arrangements advantageously allow flooring units and building surface components of elevated building surface assemblies to be readily secured to an underlying support structure thereby resisting inadvertent dislodgement and removal of the flooring units and building surface components from the support structure while also allowing for the selective removal of such flooring units and building surface components when needed. The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention.

As one example, while a single building surface component 102 is shown being laid over a single support plate 300 in the figures herein, it is envisioned that two or more building surface components 102 may be laid over and supported on a single support plate 300. As another example, it is envisioned that at least some support plates 300 of an assembly 100 may extend over at least three or more rows of support pedestals 201 such that one or more support pedestals 201 may support the support plate 300' at locations other than near the corner portions 316 of the support plate 300. For instance, one or more support pedestals 201 may be located at locations along one or more of the outer edge segments 320 that are halfway between the corner portions 316, one or more support pedestals 201 may be disposed underneath a central portion of the base 304 of the support plate 300, and/or the like. Restraint members 600 may also be utilized to secure flooring units 450 and building surface components to underlying support structures (e.g., support pedestals 201) at locations other than adjacent the corner portions of the flooring units 450 and building surface components (e.g., halfway along the outer edges or the like).

While the restraint members 600 have been illustrated as being the same length as or shorter than the outer edges of the flooring units 450 and building surface components, one or more of the restraint members 600 may be longer than the length of the outer edges of the flooring units 450 or building surface components. Still further, the restraint members 600 do not necessarily always need to be utilized with the flooring units 450 including the building surface components 102 and support plates 300 as disclosed herein and can be utilized with almost any building surface component or tile that includes a slot (e.g., gap, opening, notch, etc.) along an outer edge segment thereof into which the restraint member 600 can be received. As just one example, and with reference to Figure, the flooring unit 450 could be replaced with a flooring unit 450'. In this case, the spacing member 700 may not be necessary.

It is also to be understood that the various components disclosed herein, spaces between adjacent components, etc. are not necessarily drawn to scale. Also, many components have been labeled herein as "first," "second," "third," etc. merely to assist the reader in understanding the relationships between the components and does not imply that an elevated building surface assembly encompassed herein need necessarily have the specific arrangements shown and described herein.

One or more various combinations of the above discussed arrangements and embodiments are also envisioned. While this disclosure contains many specifics, these should not be construed as limitations on the scope of the disclosure or of what may be claimed, but rather as descriptions of features specific to particular embodiments of the disclosure. Furthermore, certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be separated from the combination, and the claimed combination may be directed to a subcombination or variation of a sub combination.

What is claimed is:

1. An elevated flooring surface assembly, comprising:

a plurality of support apparatuses spacedly disposed upon a fixed surface;

a plurality of flooring units disposed over upper surfaces of the support apparatuses to create an elevated flooring surface, wherein each flooring unit includes:

a support plate including:

a base having a top surface, a bottom surface opposite to the top surface, a plurality of corner portions, a plurality of outer edge segments disposed between adjacent corner portions, and an outer periphery formed by the plurality of outer edge segments and the plurality of corner portions, wherein the top surface resides in a first reference plane; and at least a first attachment member interconnected to the base adjacent a first of the outer edge segments, wherein the first attachment member is disposed outside of the outer periphery of the base, wherein the first attachment member includes a top surface and a bottom surface opposite to the top surface, and wherein the top surface of the first attachment member is disposed between the first reference plane and the bottom surface of the first attachment member; and a building surface component positioned over the support plate, wherein the building surface component includes a top surface, a bottom surface opposite to the top surface, a plurality of corner portions, and a plurality of outer edge segments disposed between adjacent corner portions, wherein the bottom surface of the building surface component is disposed over the top surface of the base of the support plate; and a plurality of restraint apparatuses, wherein each restraint apparatus includes a base having a top surface and a bottom surface opposite to the top surface, wherein each restraint apparatus includes a spacer member extending upwardly away from the top surface of the restraining apparatus base, wherein the base of each restraint member is disposed over the top surfaces of the first attachment members of at least first and second of the flooring units and secured to the upper surface of at least one of the support apparatuses, and wherein the spacer of each of restraint member spaces the first and second flooring units from each other.

2. The assembly of claim 1, wherein the base of each restraint member is disposed over the top surfaces of the first attachment members of at least third and fourth of the flooring units.

3. The assembly of claim 2, wherein the spacer member of each restraint member is a first spacer member, and wherein each restraint member further includes a second spacer member that spaces the third and fourth flooring units from each other.

4. The assembly of claim 1, wherein the top surface of the base member of each restraint member is disposed below the bottom surfaces of the building surface components of the first and second flooring units.

5. The assembly of claim 4, wherein the top surface of the first attachment member of each flooring unit is disposed in a second reference plane that is parallel to the first reference plane.

6. The assembly of claim 1, wherein each restraint member further includes at least one handle member extending upwardly away from the top surface of the base, wherein each handle member includes a free end that extends above the top surfaces of the building surface components of the first and second flooring units.

7. The assembly of claim 1, wherein each flooring unit includes a gap between the top surface of its first attachment member and the bottom surface of its building surface component, wherein at least one of the restraint members is received in the gap.

8. The assembly of claim 1, wherein the top surface of the first attachment member of each flooring unit is disposed in a second reference plane that is parallel to the first reference plane.

9. The assembly of claim 1, wherein each support plate further includes a second attachment member interconnected to the base adjacent a second of the outer edge segments, wherein the second attachment member is disposed outside of the outer periphery of the base, wherein the second attachment member includes a top surface and a bottom surface opposite to the top surface, and wherein the top surface of the second attachment member is disposed between the first reference plane and the bottom surface of the second attachment member.

10. The assembly of claim 1, wherein each support apparatus comprises a support pedestal having a base member, a support member, and a central section interconnecting the base and support members, wherein the upper surfaces of the support apparatuses comprise an upper surface of the support members.

11. An elevated flooring surface assembly, comprising:

a plurality of support apparatuses spacedly disposed upon a fixed surface;

a plurality of flooring units disposed over upper surfaces of the support apparatuses to create an elevated flooring surface; and a plurality of restraint apparatuses disposed over portions of the flooring units and secured to the support apparatuses to limit movement of the flooring units away from the support apparatuses, wherein each restraint apparatus includes a base having a top surface and a bottom surface opposite to the top surface, wherein each restraint apparatus includes a spacer member extending upwardly away from the top surface of the restraining apparatus base spacing adjacent flooring units;

wherein a first of the flooring units includes:

a support plate including:

a base having a top surface, a bottom surface opposite to the top surface, a plurality of corner portions, a plurality of outer edge segments disposed between adjacent corner portions, and an outer periphery formed by the plurality of outer edge segments and the plurality of corner portions, wherein the top surface resides in a first reference plane; and at least a first attachment member interconnected to the base adjacent a first of the outer edge segments, wherein the first attachment member is disposed outside of the outer periphery of the base, wherein the first attachment member includes a top surface and a bottom surface opposite to the top surface, and wherein the top surface of the first attachment member is disposed between the reference plane and the bottom surface of the first attachment member; and a building surface component positioned over the support plate, wherein the building surface component includes a top surface, a bottom surface opposite to the top surface, a plurality of corner portions, and a plurality of outer edge segments disposed between adjacent corner portions, wherein the bottom surface of the building surface component is disposed over the top surface of the base of the support plate;

wherein a second of the flooring units includes:

a building surface component having a top surface, a bottom surface opposite to the top surface, a plurality of corner portions, a plurality of outer edge segments disposed between adjacent corner portions, and a first opening disposed in a first of the outer edge segments; and wherein the base of a first of the restraint members is disposed over the top surface of the first attachment member of the first flooring unit and within the opening in the first outer edge segment of the second flooring unit, wherein the base of the first restraint member is secured to a first of the support apparatuses, and wherein the spacer of the first restraint member spaces the first and second flooring units from each other.

12. The assembly of claim 11, wherein:

a third of the flooring units includes:

a support plate including:

a base having a top surface, a bottom surface opposite to the top surface, a plurality of corner portions, a plurality of outer edge segments disposed between adjacent corner portions, and an outer periphery formed by the plurality of outer edge segments and the plurality of corner portions, wherein the top surface resides in a first reference plane; and at least a first attachment member interconnected to the base adjacent a first of the outer edge segments, wherein the first attachment member is disposed outside of the outer periphery of the base, wherein the first attachment member includes a top surface and a bottom surface opposite to the top surface, and wherein the top surface of the first attachment member is disposed between the first reference plane and the bottom surface of the first attachment member; and a building surface component positioned over the support plate, wherein the building surface component includes a top surface, a bottom surface opposite to the top surface, a plurality of corner portions, and a plurality of outer edge segments disposed between adjacent corner portions, wherein the bottom surface of the building surface component is disposed over the top surface of the base of the support plate;

a fourth of the flooring units includes:

a building surface component having a top surface, a bottom surface opposite to the top surface, a plurality of corner portions, a plurality of outer edge segments disposed between adjacent corner portions, and a first opening disposed in a first of the outer edge segments; and the base of the first restraint member is disposed over the top surface of the first attachment member of the third flooring unit and within the opening in the first outer edge segment of the fourth flooring unit.

13. The assembly of claim 12, wherein the spacer member of the first restraint member is a first spacer member, and wherein the first restraint member further includes a second spacer member that spaces the third and fourth flooring units from each other.

14. The assembly of claim 12, wherein the top surface of the base member of the first restraint member is disposed below the bottom surfaces of the building surface components of the first and third flooring units.

15. The assembly of claim 11, wherein the top surface of the base member of the first restraint member is disposed below the bottom surface of the building surface component of the first flooring unit and above the bottom surface of the building surface component of the second flooring unit.

16. The assembly of claim 11, wherein the first flooring unit includes a gap between the top surface of its first attachment member and the bottom surface of its building surface component, wherein the first restraint member is received in the gap.

17. The assembly of claim 11, wherein the first opening in the first outer edge segment of the fourth flooring unit is a slot.

18. An elevated flooring surface assembly, comprising:

a plurality of support apparatuses spacedly disposed upon a fixed surface;

a plurality of flooring units disposed over upper surfaces of the support apparatuses to create an elevated flooring surface, wherein each flooring unit includes a building surface component having a top surface, a bottom surface opposite to the top surface, a plurality of corner portions, a plurality of outer edge segments disposed between adjacent corner portions, and a first opening disposed in a first of the outer edge segments; and a plurality of restraint apparatuses disposed over portions of the flooring units and secured to the support apparatuses to limit movement of the flooring units towards and/or away from the support apparatuses, wherein each restraint apparatus includes a base having a top surface and a bottom surface opposite to the top surface, wherein each restraint apparatus includes a spacer member extending upwardly away from the top surface of the restraining apparatus base for spacing adjacent flooring units, wherein the base of a first of the restraint apparatuses is disposed in the first openings of first and second of the flooring units, wherein the spacer member of the first restraint apparatus is disposed between the first outer edge segments of the first and second flooring units.

19. The assembly of claim 18, wherein the spacer member of the first restraint member is a first spacer member, and wherein the first restraint member further includes a second spacer member that spaces third and fourth of the flooring units from each other.

20. The assembly of claim 19, wherein the top surface of the base member of the first restraint member is disposed below the bottom surfaces of the building surface components of the first, second, third and fourth flooring units.

* * * * *